US010252878B1

(12) United States Patent
Brown

(10) Patent No.: US 10,252,878 B1
(45) Date of Patent: Apr. 9, 2019

(54) CONTAINER SYSTEMS AND METHODS FOR SPOOLS AND BOBBINS FOR STORING THREAD

(71) Applicant: Christopher Jack Brown, Deming, WA (US)

(72) Inventor: Christopher Jack Brown, Deming, WA (US)

( * ) Notice: Subject to any disclaimer, the term of this patent is extended or adjusted under 35 U.S.C. 154(b) by 1050 days.

(21) Appl. No.: 14/557,285

(22) Filed: Dec. 1, 2014

Related U.S. Application Data

(60) Provisional application No. 61/963,319, filed on Dec. 2, 2013.

(51) Int. Cl.

| | |
|---|---|
| ***B65H 49/38*** | (2006.01) |
| ***B65D 85/04*** | (2006.01) |
| ***B65D 85/672*** | (2006.01) |
| *B65D 21/02* | (2006.01) |
| *B65D 25/04* | (2006.01) |

(52) U.S. Cl.
CPC ..... *B65H 49/38* (2013.01); *B65D 85/04* (2013.01); *B65D 85/672* (2013.01); *B65D 21/0209* (2013.01); *B65D 25/04* (2013.01)

(58) Field of Classification Search
CPC ..... B65H 49/38; B65H 49/36; B65H 75/00; B65D 85/66; B65D 85/672; B65D 85/671; B65D 85/04; B65D 25/106; B65D 21/068; B65D 21/08; B65D 21/02; B65D 21/0209; B65D 21/0212; B65D 25/04; B65D 1/36; B65D 5/48; B65D 5/48002
USPC ..... 206/404, 403, 493, 561, 565, 501, 514, 206/504, 509; 220/23.86, 23.83, 23.89
See application file for complete search history.

(56) References Cited

U.S. PATENT DOCUMENTS

| | | | | | |
|---|---|---|---|---|---|
| 243,443 | A * | 6/1881 | Gould | A47F 7/02 | 206/561 |
| 712,965 | A * | 11/1902 | Reiner | A45C 13/03 | 206/291 |
| 1,924,371 | A * | 8/1933 | Owitz | A47F 3/14 | 206/389 |
| 2,463,106 | A * | 3/1949 | Hocker | G05B 19/41875 | 206/561 |
| 3,283,892 | A * | 11/1966 | Rosen | B65D 85/04 | 206/392 |
| 3,293,892 | A * | 12/1966 | Falk | E05B 9/045 | 70/358 |
| 4,501,361 | A * | 2/1985 | Rose, Jr. | B65D 25/106 | 206/303 |

(Continued)

*Primary Examiner* — Robert Poon
(74) *Attorney, Agent, or Firm* — Schacht Law Office, Inc.; Michael R. Schacht

(57) ABSTRACT

A storage system for containing at least one of a spool defining a spool passageway and at least one bobbin defining a bobbin passageway comprising first and second containers. The first container contains at least one spool and defines at least one of a first upper connecting portion and a first lower connecting portion. The second container contains at least one bobbin and defines at least one of a second upper connecting portion and a second lower connecting portion. The first upper connecting portion engages the second lower connecting portion to detachably attach the first and second containers in a first configuration. The second upper connecting portion engages the first lower connecting portion to detachably attach the first and second containers in a second configuration.

17 Claims, 8 Drawing Sheets

(56) References Cited

U.S. PATENT DOCUMENTS

| | | | | | |
|---|---|---|---|---|---|
| 4,940,143 | A * | 7/1990 | Stanfield | A45C 13/02 | 206/511 |
| 5,699,925 | A * | 12/1997 | Petruzzi | B65D 21/0204 | 206/508 |
| 7,097,036 | B2 * | 8/2006 | Morita | G11B 23/0233 | 206/501 |
| 8,602,217 | B2 * | 12/2013 | Sosnovsky | B25H 3/021 | 206/503 |
| 8,770,430 | B2 * | 7/2014 | Nyeboer | B65D 19/06 | 206/485 |
| 2007/0256947 | A1 * | 11/2007 | Bernard | B65D 25/106 | 206/408 |
| 2008/0121559 | A1 * | 5/2008 | Friedrich | B65D 85/672 | 206/701 |
| 2015/0021322 | A1 * | 1/2015 | Rosenblum | B65D 21/0223 | 220/23.89 |
| 2015/0239612 | A1 * | 8/2015 | Wang | B65D 81/3216 | 220/23.89 |

* cited by examiner

CONTAINER SYSTEMS AND METHODS FOR SPOOLS AND BOBBINS FOR STORING THREAD

RELATED APPLICATION

This application, U.S. patent application Ser. No. 14/557,285 filed Dec. 1, 2014, claims benefit of U.S. Provisional Application Ser. No. 61/963,319 filed Dec. 2, 2013, which is incorporated by reference herein in its entirety.

TECHNICAL FIELD

The present invention relates to storage systems and methods and, in particular, to storage systems and methods for spools and bobbins used to carry sewing thread.

BACKGROUND

Sewing typically requires the use of thread of many colors. For each color, the thread is typically stored on a spool and a bobbin for use with sewing machines. The need exists for systems and methods of storing multiple spools and bobbins in a compact and organized manner.

SUMMARY

The present invention may be embodied as a storage system for containing at least one of a spool defining a spool passageway and at least one bobbin defining a bobbin passageway comprising first and second containers. The first container contains at least one spool and defines at least one of a first upper connecting portion and a first lower connecting portion. The second container contains at least one bobbin and defines at least one of a second upper connecting portion and a second lower connecting portion. The first upper connecting portion engages the second lower connecting portion to detachably attach the first and second containers in a first configuration. The second upper connecting portion engages the first lower connecting portion to detachably attach the first and second containers in a second configuration.

The present invention may also be embodied as a storage system for containing at least one bobbin defining a bobbin passageway, the storage system comprising a container for containing at least one bobbin. The container defines at least one pair of engaging projections supported to engage the at least bobbin to detachably attach the bobbin relative to the second container.

The present invention may also be embodied as a method of storing at least one of a spool defining a spool passageway and at least one bobbin defining a bobbin passageway comprising the following steps. A first container for containing at least one spool is provided. At least one of a first upper connecting portion and a first lower connecting portion are formed on the first container. A second container for containing at least one bobbin is provided. At least one of a second upper connecting portion and a second lower connecting portion is formed on the second container. The first upper connecting portion engages the second lower connecting portion to detachably attach the first and second containers in a first configuration. The second upper connecting portion engages the first lower connecting portion to detachably attach the first and second containers in a second configuration.

DETAILED DESCRIPTION

Figure 1:
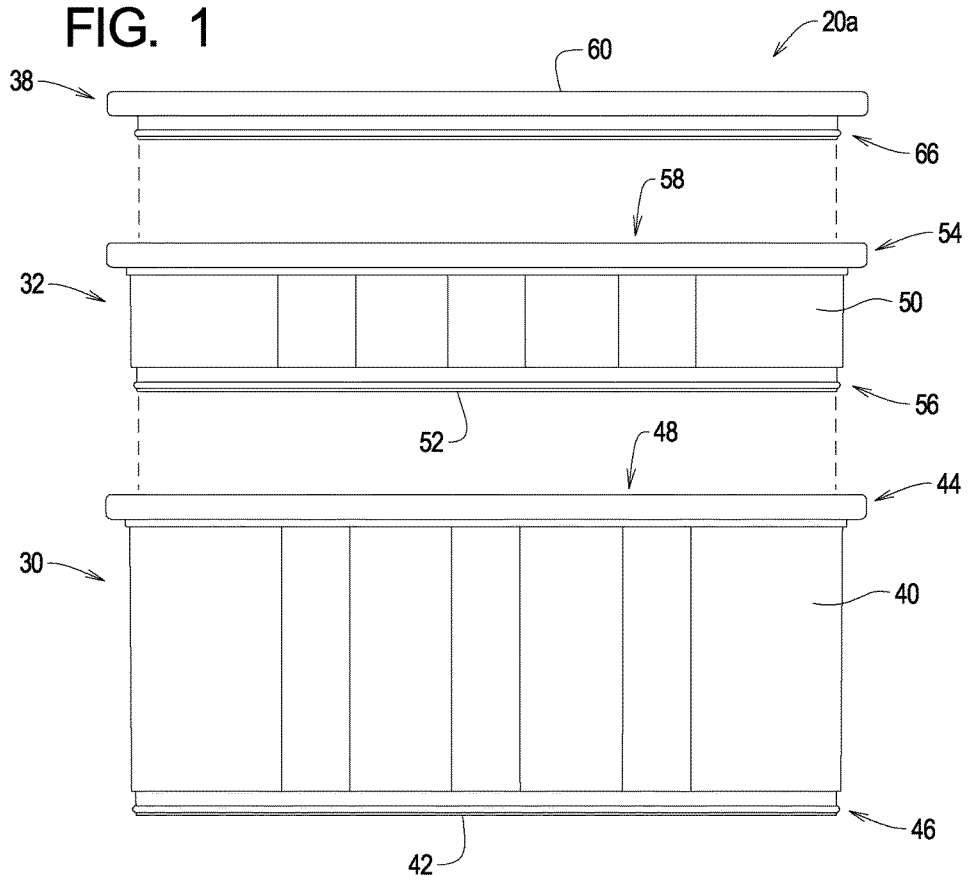
FIG. 1 is a side elevation, exploded view of a first example storage system of the present invention.

Referring initially to FIGS. 1-5 of the drawing, depicted therein is a first example storage system 20*a* constructed in accordance with, and embodying, the principles of the present invention. The example storage system 20*a* is of particular significance when used to store sewing items such as spools 22 and/or bobbins 24 containing thread and that application of the present will be described in detail herein.

FIG. 1 illustrates that the first example storage system 20*a* comprises a first container 30 and a second container 32. The first container 30 defines a first chamber 34, and the second container defines a second chamber 36. The first example storage system 20*a* further comprises an optional cover member 38.

Figure 2:
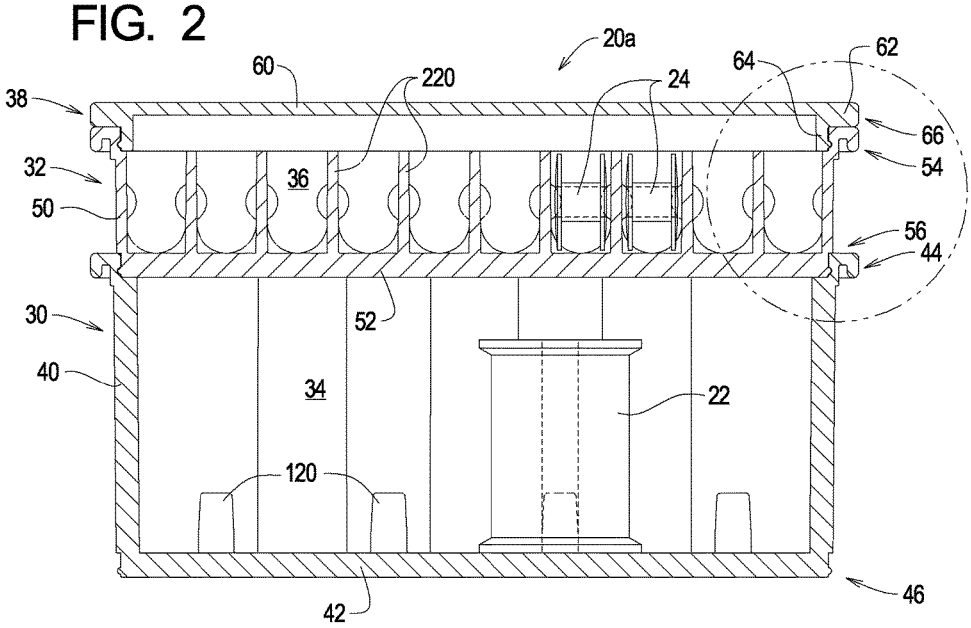
FIG. 2 is a side elevation section view of the first example storage system.
Figure 5:
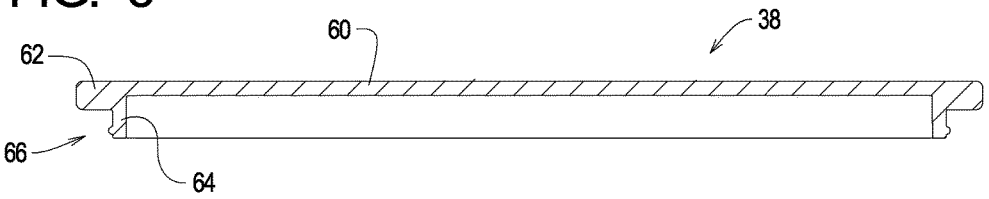
FIG. 5 is a section view of an example cover member that may be used by the first example storage system.

FIG. 2 illustrates that the example first container 30 comprises at least one first side wall 40 and a first bottom wall 42. The example first container 30 further comprises a first upper connecting portion 44 and a first lower connecting portion 46. A first opening 48 allows access to the first chamber 34. The example second container 32 comprises at least one second side wall 50 and a second bottom wall 52. The example second container 32 further comprises a second upper connecting portion 54 and a second lower connecting portion 56. A second opening 58 allows access to the second chamber 34. FIG. 5 illustrates that the example cover member 38 comprises a cover wall 60 having a perimeter portion 62 and at least one perimeter wall 64 extending from the perimeter portion 62. A third upper connecting portion 66 is formed on the perimeter wall 64.

The example first and second containers 30 and 32 are rectangular boxes and thus comprise four of the side walls 40 and 50, respectively, but other geometric configurations defining fewer or more side walls may be used instead. The example cover member 38 is similarly rectangular and thus comprises four of the perimeter walls 64. Typically, but not necessarily, the rectangular shapes defined by the first and second containers 30 and 32 and the cover member 38 will substantially match to allow the containers 30 and 32 and cover member 38 to be detachably attached in various configurations as be described in further detail below. In any case, at least a portion of the shapes defined by the first and second containers 30 and 32 and the cover member 38 will substantially match to allow the containers 30 and 32 and cover member 38 to be detachably attached.

Figure 3:
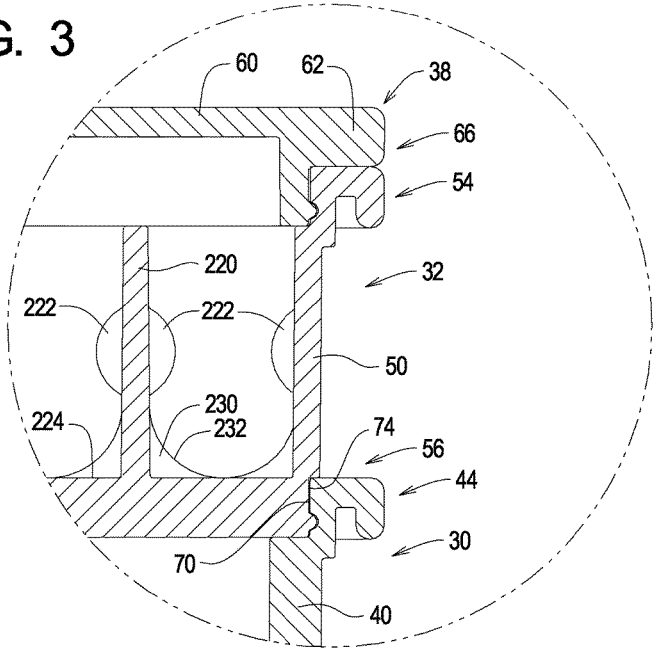
FIG. 3 is a is a detail of a portion of FIG. 2.

Referring now more specifically to FIGS. 2 and 3 of the drawing, those figures illustrate that the first upper connecting portion 44 is adapted to engage the second lower connecting portion 56 to detachably attach the first and second containers 30 and 32 with the second container 32 above the first container 30. Alternatively, the first lower connecting portion 46 may engage the second upper connecting portion 54 to detachably attach the first and second containers 30 and 32 with the first container 30 above the second container 32. FIGS. 2 and 3 further illustrate that the third upper connecting portion 66 engages the second upper connecting portion 54 to detachably attach the example cover member 38 to the second container 32. When the second container 32 is detachably attached to the first container 30 and the cover member 38 is detachably attached to the second container 32, the first and second openings 48 and 58 are covered, and the first and second chambers 34 and 36 are substantially sealed.

The upper connecting portions 44 and 54 are functionally equivalent to each other, and the lower connection portions 46, 56, and 66 are functionally equivalent to each other. The example first upper connecting portion 44 and second lower connection portion 56 will be described in detail with reference to FIG. 4 with the understanding that the following description also applies to the second connecting portions 54 and the first and third lower connecting portions 46 and 66.

Figure 4:
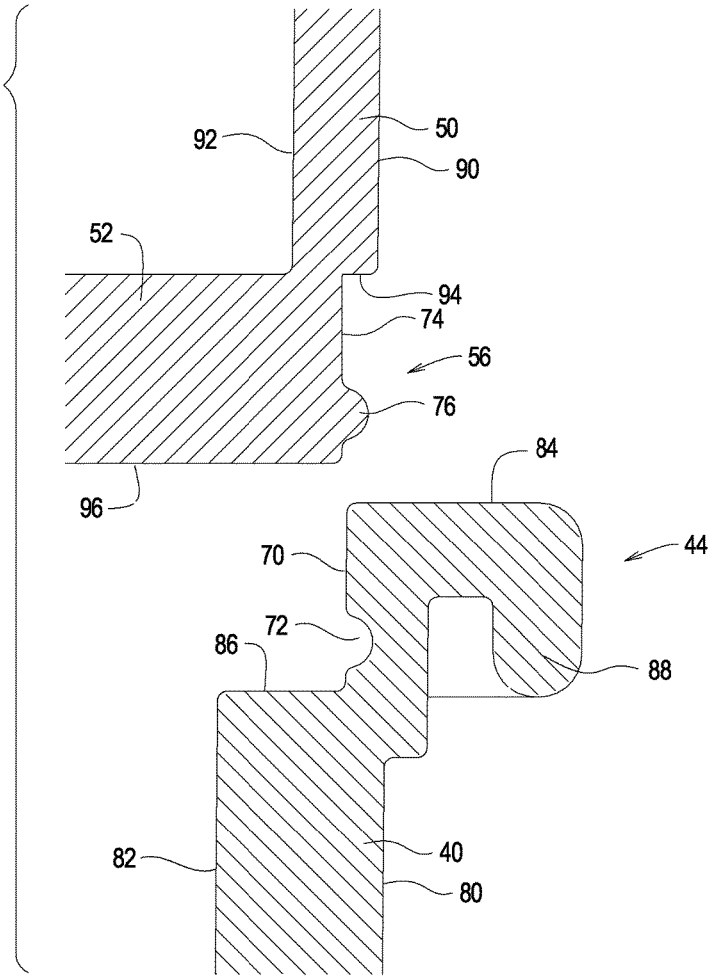
FIG. 4 is a is an exploded view of a portion of FIG. 3.

FIG. 4 illustrates that the upper connecting portion 44 comprises an upper connecting wall surface portion 70 and an upper connecting element 72 and that the lower connecting portion 56 comprises a lower connecting wall surface portion 74 and a lower connecting element 76. The upper connecting wall surface portion 70 is inwardly facing, and the lower connecting wall surface portion 74 is outwardly facing. The example upper connecting element 72 is, in side profile, an inwardly facing rounded recess in the upper connecting wall surface portion 70, while the example lower connecting element 76 is, in side profile, a rounded projection extending outwardly from the lower connecting wall surface portion 74. Alternatively, the lower connecting element 76 may be formed by a recess and the upper connecting element 72 may be formed by a projection. The rounded recess forming the upper connecting element 76 may take the form of an elongate recess extending the length of and along a lower edge of one or more of the side walls 40, while the rounded projection forming the lower connecting element 76 may take the form of an elongate projection extending the length of and along an upper edge of one or more of the side walls 50. Alternatively, a plurality of discrete projections and/or recesses may be formed on the side walls 40 and 50 to form a mechanical engagement as described below.

In any case, in use as shown in FIG. 3, the upper connecting wall surface portion 70 fits snugly adjacent to the lower connecting wall surface portion 74. When in an attached configuration, the rounded recess forming the example upper connecting element 72 receives the rounded projection forming the example lower connecting element 76 to detachably attach the second container 32 to the first container 30. The lower connecting element(s) 76 thus mechanically engages the upper connecting element(s) 72 to inhibit movement of the second container 32 relative to the first container 30.

FIG. 4 further illustrates that the at least one side wall 40 of the example first container 30 defines a first side wall outer surface 80 and a first side wall inner surface 82. The example first upper connecting portion 44 defines an upper support surface 84, while the example first side wall 40 defines a first side wall upper surface 86. A first side wall lip portion 88 extends from the first side wall 40 adjacent to the upper support surface 84. The at least one second side wall 50 of the example second container 32 defines a second side wall outer surface 90 and a second side wall inner surface 92. The example second lower connecting portion 56 defines a lower support surface 94, and the example second bottom wall 52 defines a second bottom wall lower surface 96.

When the first upper connecting portion 44 engages the second lower connecting portion 56 to detachably attach the first and second containers 30 and 32, the upper support surface 84 engages the lower support surface 94 and the first side wall upper surface 86 engages the second bottom wall lower surface 96. In addition, the example side wall outer surfaces 80 and 90 of the first and second side walls 40 and 50 are substantially aligned. The side wall lip portion 88 extends out from the aligned side walls 40 and 50 to facilitate the engagement and disengagement of the first upper connecting portion 44 from the second lower connecting portion 56.

As generally discussed above, either of the upper connecting portions 44 and 54 may engage any of the lower connection portions 46, 56, and 66, thereby allowing the first container 30, second container 32, and optional cover member 38 to be detachably attached in various configurations. The example first and second containers 30 and 32 are made of deformable material to allow the connecting elements 72 and/or 76 form the mechanically engagement depicted in FIGS. 3 and 4. In particular, the example containers 30 and 32 and cover member 38 are made of a material such as flexible rubber or plastic. The example containers 30 and 32 and cover member 38 are made of material within a range of 60-80 durometer with a light texture, but other materials may be used. The example first and second containers 30 and 32 are made of Thermoplastic Elastomer, but other materials such as rubber, polyethylene, polypropylene, nylon, and other plastic materials may be used in addition or instead.

Figure 6:
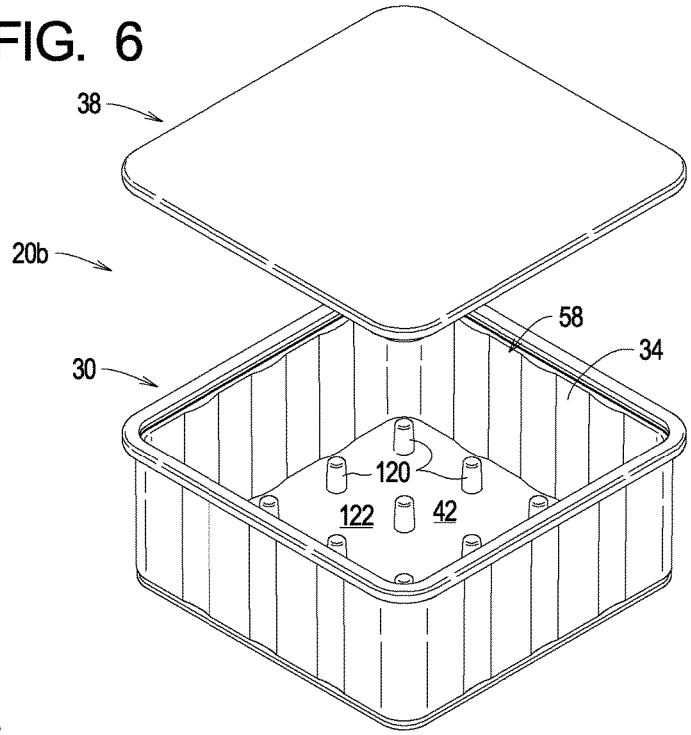
FIG. 6 is a perspective, exploded view of a second example storage system of the present invention.
Figure 7:
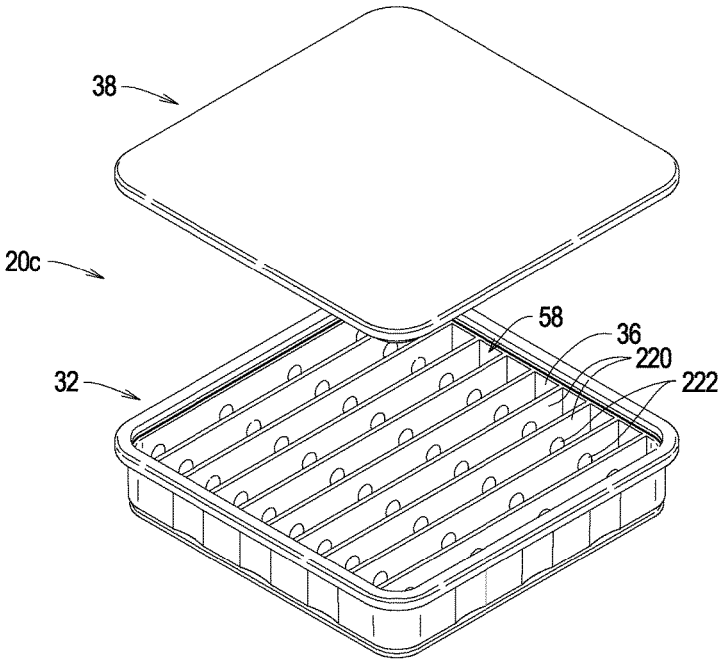
FIG. 7 is a perspective, exploded view of a third example storage system of the present invention.

As one example, as shown in FIG. 6, the cover member 38 may be detachably attached to the first container 30 to form a second example storage system 20*b* of the present invention. Similarly, as shown in FIG. 7 the cover member 38 may be detachably attached to the second container 32 to form a third example storage system 20*c* of the present invention. Additional storage systems of the present invention may be formed by combining a plurality of the first containers 30 with one or more of the second containers 32 or one or more of the first containers 30 with a plurality of the second containers 32. In any given storage system of the present invention, one of the cover members 38 may be provided to cover the uppermost of the first or second containers 30 or 32 in the given storage system.

Figure 8:
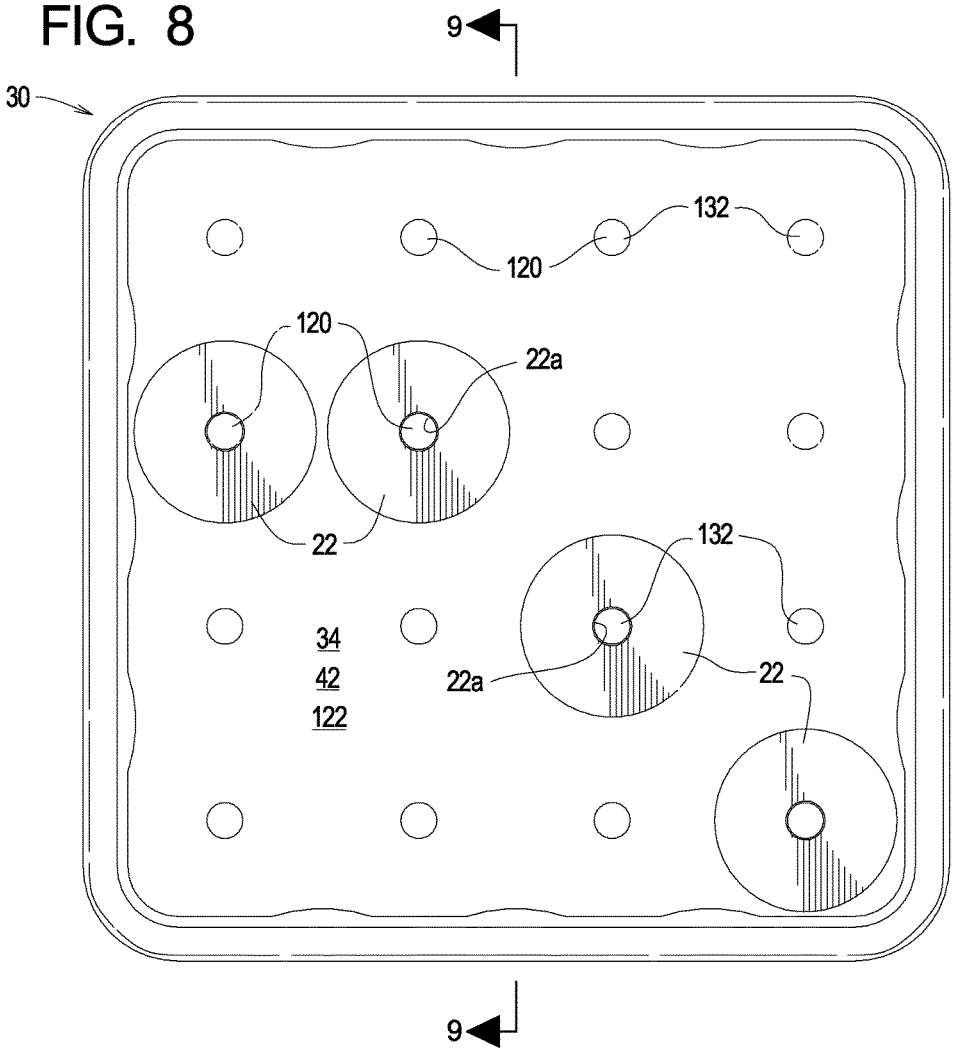
FIG. 8 is a top plan view of a spool container that may be used by the first and/or second example storage systems.
Figure 9:
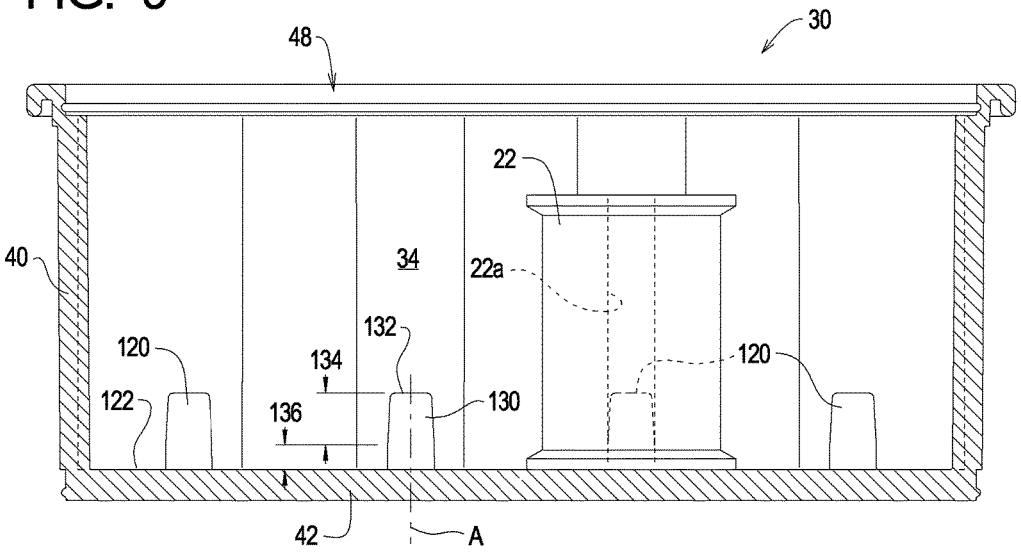
FIG. 9 is a side elevation section view of a spool stored within the example spool container of FIG. 8.
Figure 10:
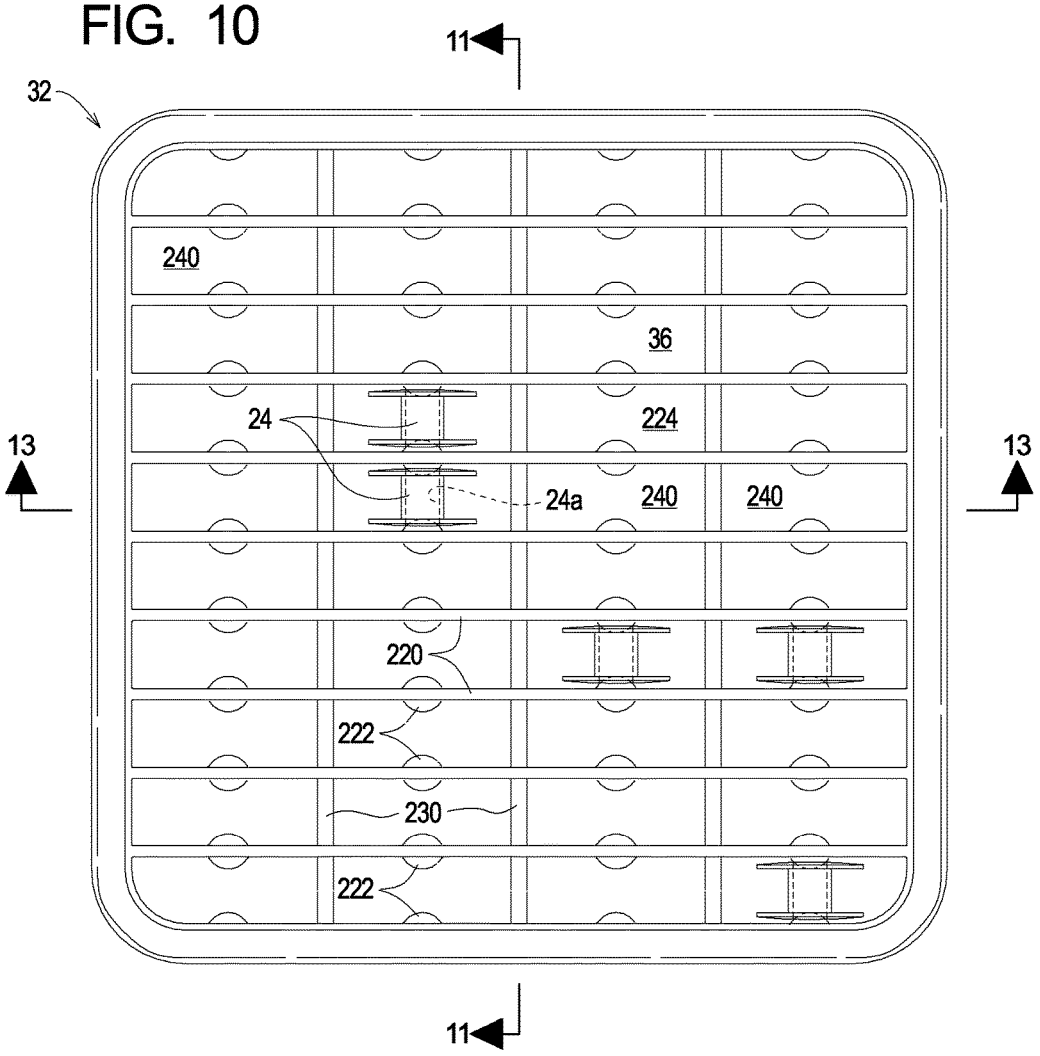
FIG. 10 is a top plan view of a bobbin container that may be used by the first and/or third example storage systems.
Figure 11:
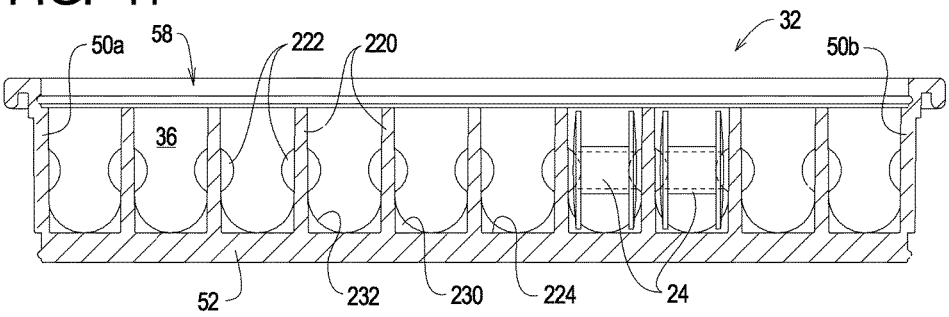
FIG. 11 is a side elevation section view of bobbins stored within the example bobbin container of FIG. 10.

Turning now to FIGS. 8 and 9 of the drawing, the example first storage container 30 will now be described in further detail. FIGS. 8 and 9 illustrate that the first storage container 30 comprises at least one support post 120 extending from a first bottom wall inner surface 122 defined by the first bottom wall 42. Typically, a plurality of the support posts 120 will be provided, with 16 support posts being shown in FIG. 8. FIG. 9 illustrates that each support post 120 comprises a post side surface 130 and a post distal surface 132. The post distal surface 132 is substantially flat, while the post side surface 130 defines a post guide surface portion 134 and a post engaging surface portion 136. FIG. 9 also illustrates that the spools 22 each define a spool passageway 22*a*. At least a portion of the post guide surface portion 134 is angled with respect to a center longitudinal axis A of the post 120 to form a reduced cross-section area of the post 120 that may easily enter the spool passageway 22*a*. The example post engaging surface portion 136 is substantially the same diameter as the spool passageway 22*a* so that the post engaging surface portion 136 frictionally engages the spool 22 to inhibit relative movement between the post 120 and the spool 22.

Each of the posts 120 is capable of detachably attaching one of the spools 22 within the first chamber 34, so the example first container 30 is capable of storing 16 of the spools 22. FIG. 9 shows that the chamber is sized and dimensioned such that the spools 22 may fit entirely within the first chamber 34.

The example second container 32 will now be described with reference to FIGS. 10-13 of the drawing. The example second container 32 comprises at least one main wall 220, where each main wall 220 defines at least one engaging projection 222. In addition, at least one of the engaging projections 222 extends from first and second opposing side walls 50*a* and 50*b*. The plurality of main walls 220 extend from a second bottom wall inner surface 224 defined by the second bottom wall 52 and between opposing third and fourth opposing side walls 50*c* and 50*d* of the second container 32. A plurality of optional divider walls 230 extend between the main walls 220. The example divider walls 230 each define a divider wall distal surface 232. The example distal wall surfaces 232 are arcuate as perhaps best shown in FIG. 11.

Figure 12:
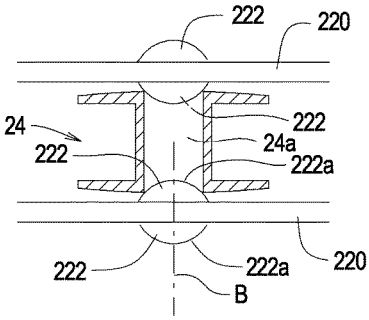
FIG. 12 is a top plan view illustrating the engagement of a bobbin with the example bobbin container of FIG. 10.
Figure 13:
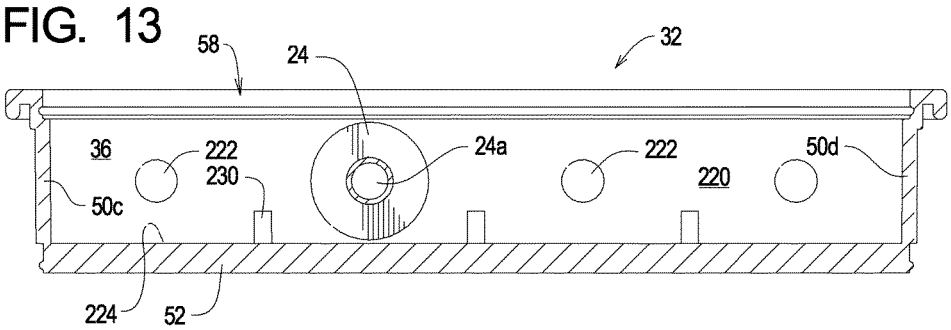
FIG. 13 is an end elevation section view of a bobbin stored within the example spool container of FIG. 10.

The main walls 220 and divider walls 230 define a plurality of compartments 240. The example second container 32 defines 40 compartments, but fewer or more may be provided with second containers 32 of different sizes. Within each of the compartments 240 is a pair of the opposing engaging projections 222, and FIG. 12 illustrates the details of a pair of engaging projections 222 for one of the compartments 240. FIG. 12 illustrates that each pair of engaging projections 222 defines a mounting axis B. FIG. 12 also illustrates that a surface 222*a* of the example engaging projections 222 take a partly spherical form and that the mounting axis B is aligned with the axis of the sphere.

Further, the example second container 32 is made of a material capable of deforming to allow the bobbin 24 to be forced between opposing projections 222 in a pair of such projections to detachably attach the bobbins 24 to the second container 32. In particular, FIG. 12 illustrates that the bobbins 24 each define a bobbin passageway 24*a*, that the main walls 220 are spaced from each other a distance slightly greater than a longitudinal length of the bobbins 24, and that the rounded surfaces 222*a* of the engaging projections 222 are sized and dimensioned to fit partly within the bobbin passageways 24*a*.

In use, one of the bobbins 24 is arranged within one of the compartments 240 and the bobbin 24 forced between the pair of engaging projections 222 within that compartment 240 such that the bobbin 24 squeezes between the pair of opposing engaging projections 222 in that compartment 240 such that the opposing. The divider walls 230 prevent the bobbins from rolling between compartments 240, but the divider wall distal surfaces 232 are curved to allow a user to insert one or more fingers within the compartments 240 to facilitate insertion and removal of the bobbins 24.

What is claimed is:

1. A storage system for containing at least one spool defining a spool passageway and at least one bobbin defining a bobbin passageway, the storage system comprising:

a first container for containing at least one spool, the first container defining a first chamber, at least one of a first upper connecting portion and a first lower connecting portion, a first bottom wall, and at least one support post extending from the first bottom wall into the first chamber;

a second container for containing at least one bobbin, the second container defining a second chamber, at least one of a second upper connecting portion and a second lower connecting portion, a second bottom wall, at least one main wall extending from the second bottom wall into the second chamber to define at least one compartment, and at least one engaging projection extending from the at least one main wall into the at least one compartment; wherein the first upper connecting portion is capable of engaging the second lower connecting portion to detachably attach the first and second containers in a first configuration;

the second upper connecting portion is capable of engaging the first lower connecting portion to detachably attach the first and second containers in a second configuration;

the at least one support post is sized and dimensioned to extend at least partly into the spool passageway of the at least one spool to allow the at least one spool to be detachably attached to the first container within the first chamber;

the at least one engaging projection is sized and dimensioned to engage the at least one bobbin adjacent to the at least one bobbin passageway to allow the at least one bobbin to be detachably attached to the second container within the at least one compartment of the second chamber; and the at least one main wall is made of a deformable material to allow displacement of at least a portion of the at least one engaging projection as the at least one engaging projection engages the at least one bobbin.

2. A storage system as recited in claim 1, in which:

the first upper connecting portion and the second upper connecting portion each comprise an upper connecting element;

the first lower connecting portion and the second lower connecting portion each comprise a lower connecting element; wherein the upper connecting elements mechanically engage the lower connecting elements to inhibit movement of the second container relative to the first container.

3. A storage system as recited in claim 1, in which:

the upper connecting element is a projection; and the lower connecting element is a recess; wherein the recess forming the lower connecting element is sized and dimensioned to receive the projection forming the upper connecting element.

4. A storage system as recited in claim 1, in which:

the upper connecting element is a recess; and the lower connecting element is a projection; wherein the recess forming the upper connecting element is sized and dimensioned to receive the projection forming the lower connecting element.

5. A storage system as recited in claim 1, in which the first container comprises a plurality of support posts, where each support post is adapted to engage one of the at least one spools.

6. A storage system as recited in claim 1, in which the at least one support post defines:

a guide surface portion for facilitating insertion of the at least one support post into the spool passageway; and an engaging surface portion for frictionally engaging the spool.

7. A storage system as recited in claim 5, in which the at least one support post extends from a bottom wall of the first container into a first cavity defined by the first container.

8. A storage system as recited in claim 1, in which:

the second container defines first and second main walls extending from the second bottom wall into the second chamber to define the at least one compartment and first and second engaging projections extending from the first and second main walls, respectively, into the at least one compartment;

the first and second engaging projections are sized and dimensioned to engage the at least one bobbin on opposite ends of the at least one bobbin passageway to allow the at least one bobbin to be detachably attached to the first container within the at least one compartment of the second chamber; and the first and second main walls are made of a deformable material to allow displacement of the first and second engaging projections as the first and second engaging projections engage the at least one bobbin.

9. A storage system as recited in claim 1, in which:

the second container further defines at least one side wall;

a first engaging projection is formed on the at least one main wall;

a second engaging projection is formed on the at least one side wall;

the first and second engaging projections are sized and dimensioned to engage the at least one bobbin on opposite ends of the at least one bobbin passageway to allow the at least one bobbin to be detachably attached to the first container within the at least one compartment of the second chamber; and the at least one main wall and the at least one side wall are made of a deformable material to allow displacement of the first and second engaging projections as the first and second engaging projections engage the at least one bobbin.

10. A storage system as recited in claim 1, in which the second container further defines:

a plurality of main walls extending between first and second opposing side walls, where at least one engaging projection is formed on each of the main walls;

third and fourth opposing side walls, where at least one engaging projection is formed on each of the third and fourth opposing side walls; and the plurality of main walls and the first, second, third, and fourth side walls are made of a deformable material to allow displacement of at least a portion of the engaging projections as the engaging projections engage the at least one bobbin.

11. A storage system as recited in claim 7, in which each of the engaging projections is formed by a spherical surface, where the spherical surfaces defined by pairs of opposing engaging projections extend at least partly into the bobbin passageway from opposite directions.

12. A storage system for containing at least one bobbin defining a bobbin passageway, the storage system comprising:

a container for containing at least one bobbin, the container defining a bobbin chamber, a bottom wall, at least one main wall extending from the bottom wall into the bobbin chamber to define at least one compartment, and at least one pair of engaging projections defining a mounting axis, where each of the engaging projections is supported by the container to extend into the at least one compartment; wherein at least one of the pair of engaging projections is supported by the at least one main wall;

each of the engaging projections is sized and dimensioned to engage the bobbin passageway of the at least one bobbin such that the at least one bobbin may be detachably attached to the container within the at least one compartment of the bobbin chamber, and the mounting axis defined by the at least one pair of engaging projections is at least partly within the bobbin passageway when the at least one bobbin is detachably attached to the container; and the container is made of a deformable material to allow displacement of at least a portion of the engaging projections as at least one engaging projection engages the at least one bobbin.

13. A storage system as recited in claim 12, in which at least one engaging projection of the at least one pair of engaging projections is formed on the at least one main wall.

14. A storage system as recited in claim 12, in which the container further defines at least one side wall, where at least one engaging projection of the at least one pair of engaging projections is formed on the at least one side wall.

15. A storage system as recited in claim 12, in which the container further defines at least one side wall, wherein:

at least one engaging projection of the at least one pair of engaging projections is formed on the at least one main wall; and at least one engaging projection of the at least one pair of engaging projections is formed on the at least one side wall.

16. A storage system as recited in claim 15, in which the container further defines:

a plurality of main walls extending between first and second opposing side walls, where at least one engaging projection of the at least one pair of engaging projections is formed on each of the main walls; and first and second opposing side walls and third and fourth opposing side walls, where at least one engaging projection of the at least one pair of engaging projections is formed on each of the third and fourth opposing side walls.

17. A storage system as recited in claim 15, in which each of the engaging projections is formed by a spherical surface, where the spherical surfaces defined by the pair of opposing engaging projections are configured to extend at least partly into the bobbin passageway from opposite directions when the at least one bobbin is detachably attached to the first container.

* * * * *